United States Patent [19]

Kohl

[11] 3,952,549

[45] Apr. 27, 1976

[54] GUIDEBAR COMPENSATION APPARATUS FOR USE ON WARP KNITTING MACHINES EQUIPPED WITH JACQUARD CONTROLS

[76] Inventor: Karl Kohl, Chlorodont Str. 10, Obertshausen, Germany

[22] Filed: Dec. 18, 1974

[21] Appl. No.: 534,056

[30] Foreign Application Priority Data

Jan. 15, 1974 Germany ..... 2401688

[52] U.S. Cl. ..... 66/86 E

[51] Int. Cl.[2] ..... D04B 23/00; D04B 27/00

[58] Field of Search ..... 66/86, 86 E, 84, 85, 66/87

[56] References Cited

UNITED STATES PATENTS

| | | | |
|---|---|---|---|
| 3,802,227 | 9/1974 | Kolar et al. | 66/86 C |
| 3,834,193 | 9/1974 | Wilkens | 66/84 R |

FOREIGN PATENTS OR APPLICATIONS

| | | | |
|---|---|---|---|
| 29,221 | 5/1964 | Germany | 66/86 R |

*Primary Examiner*—Ronald Feldbaum
*Attorney, Agent, or Firm*—Behr & Woodbridge

[57] ABSTRACT

A novel compensation lever is associated with the guide and dropper bars of a warp knitting machine equipped with conventional Jacquard controls. In conventional warp knitting machinery equipped with Jacquard controls, the droppers of the dropper bar often impart an undesirable force to the guide bars during the knitting operation. The novel compensation lever of this invention is so arranged that when the dropper bar is displaced in a predetermined direction, a certain proportion of the displacing impetus is transferred to the guide bar in order to bias the guide bar in the same direction as the force of the return spring attached thereto.

7 Claims, 2 Drawing Figures

GUIDEBAR COMPENSATION APPARATUS FOR USE ON WARP KNITTING MACHINES EQUIPPED WITH JACQUARD CONTROLS

BACKGROUND OF THE INVENTION

1. Field of the Invention

The invention relates generally to warp knitting machines and more particularly to a means for compensating for the undesirable influence of a dropper bar on the guide bar mechanism of such machinery.

2. Description of the Prior Art

In general, warp knitting machines and Jacquard controls are well known to those of ordinary skill in the art. For example, an adequate description of the use of Jacquard controls in the context of a warp knitting machine can be found in U.S. Pat. 3,834,193 issued Sept. 10, 1974.

While Jacquard controls do expand the versatility of a conventional warp knitting machine, nevertheless they do pose certain problems. One of the major problems is that when a large number of the droppers on the dropper bar are allowed to come in contact with the guides on the guide bar, the effect is to impart a certain amount of the impetus of the dropper bar to the guide bar. This impetus is highly undesirable because it can effect the efficient and correct operation of the machine. It was in the context of the above described prior art and the problems associated therewith that the following invention arose.

SUMMARY OF THE INVENTION

The undesirable inertial effect posed by the moving dropper bar on the guide bar of a warp knitting machine is avoided by providing a power transfer means, specifically a lever, between the guide bar, the dropper bar and the means for displacing the dropper bar. The power transfer lever is arranged so that when the dropper bar is displaced in a predetermined direction, a certain proportion of that displacing impetus is transferred to the guide bar in order to bias the guide bar in the same direction as the force of the return spring attached thereto.

Thus, the new arrangement not only provides for the compensation of the undesirable forces exerted by the dropper bar on the guide bar, but it also prevents excessive return action by the spring attached to the guide bar.

By means of this arrangement, it is therefore possible to provide for the use of an unlimited number of droppers during the displacement of the dropper bar without unduly influencing the predetermined displacement of the guide bar.

These and other features of the present invention are clearly set forth in the drawing and in the detailed description of the invention below.

DESCRIPTION OF THE INVENTION

During the course of this description, like numerals will be used to designate like elements in the different drawings.

Figure 1:
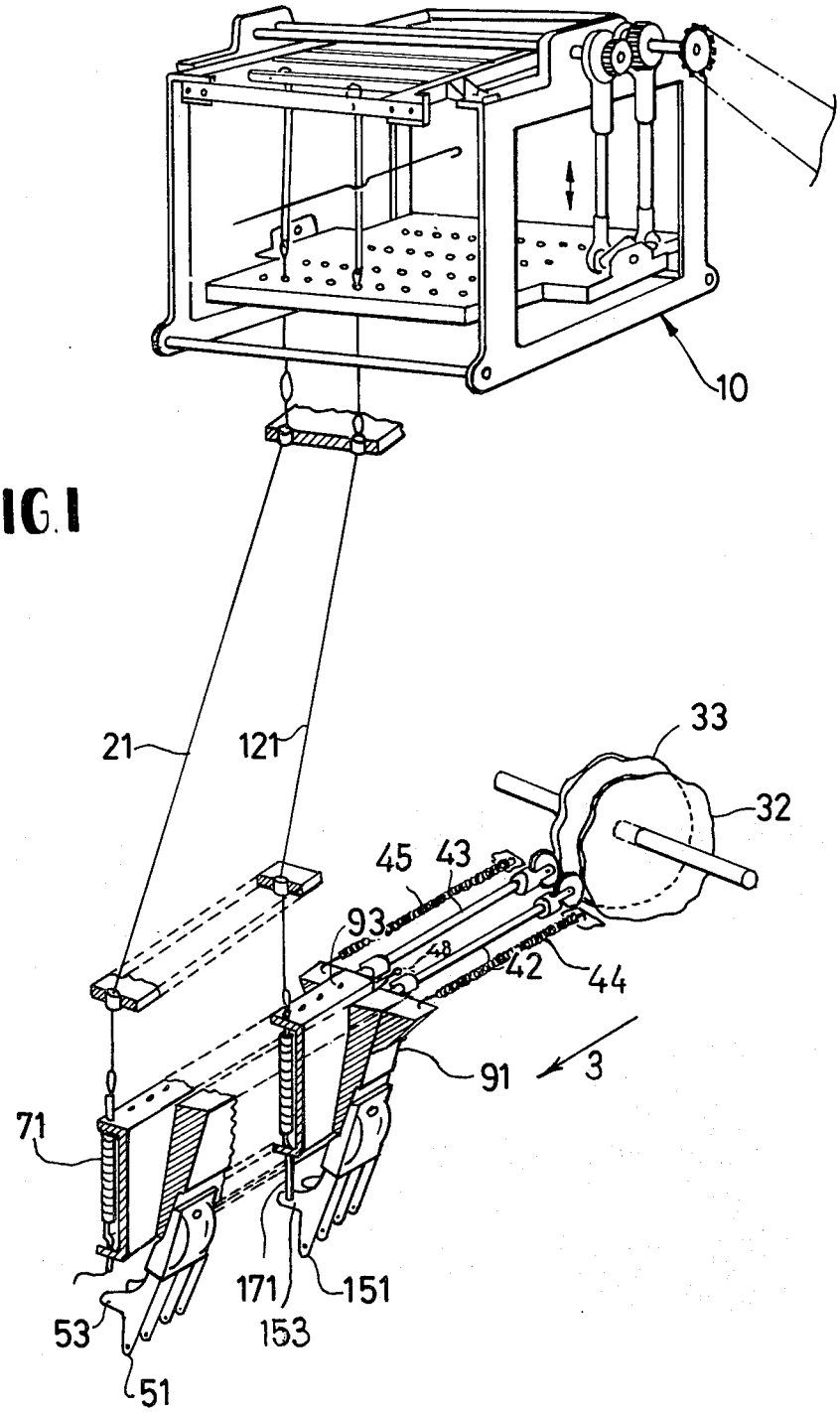
FIG. 1 is an isometric schematic of a warp knitting machine equipped with Jacquard controls and incorporating the compensation mechanism of the present invention.

The compensation means of the present device is shown in FIG. 1 in the context of a conventional warp knitting machine equipped with Jacquard controls. According to this embodiment, a pattern cam wheel 32 rotates and causes control rod 42 to reciprocate in a backward and forward fashion. Control rod 42 is in turn connected to guide bar 91. In this fashion the lateral movement of guide bar 91 is controlled by the contour of pattern cam 32 as it rotates. Guide bar 91 carries with it a plurality of thread guides 51 and 151. Thread guides 51 and 151 include protrusions 53 and 153 respectively. A spring 44 is attached at one end to guide bar 91 and at the other end to a firm anchor point. The purpose of spring 44 is to return control rod 42 after it has been laterally propelled by pattern to cam 32 in the direction of arrow 3.

In a similar manner, pattern cam 33 displaces control rod 43 in a lateral direction. Control rod 43 is attached via compensating lever 48 to dropper bar 93 and guide bar 91. Dropper bar 93 includes a plurality of droppers 71 and 171. Droppers 71 and 171 are spring loaded and are influenced in turn by control wires 21 and 121 respectively. Control wires 21 and 121 are operated by a conventional Jacquard control mechanism 10.

The Jacquard control mechanism 10 selectively draws up control wires 21 and 121 which in turn selectively draw up droppers 71 and 171 against their respective biasing springs. According to FIG. 1, dropper 71 is shown in the withdrawn or nonoperative condition. In contrast thereto, dropper 171 is shown in the operative position as it impinges upon protrusion 153 of guide 151. By selectively operating droppers 71 and 171 it is possible to produce attractive patterns and subpatterns on the material being knitted.

The problem experienced in prior art warp knitting machines equipped with Jacquard controls and droppers is that the movement of dropper bar 93 was often partially imparted to guide bar 91 whenever a large number of droppers were activated in the manner in which dropper 171 is shown to be activated with respect to guide 151. For example, if dropper bar 93 were moving in the direction of arrow 3 and a large number of droppers were activated, then there would be a tendency for guide bar 93 to move guide bar 91 in the direction of arrow 3 because of the excessive dropper/-guide physical contact. The undesirable momentum imparted by dropper bar 93 to guide bar 91 can result in serious knitting errors. This particular problem becomes more serious as more and more droppers 71 and 171 impinge upon more and more guides 51 and 151.

Figure 2:
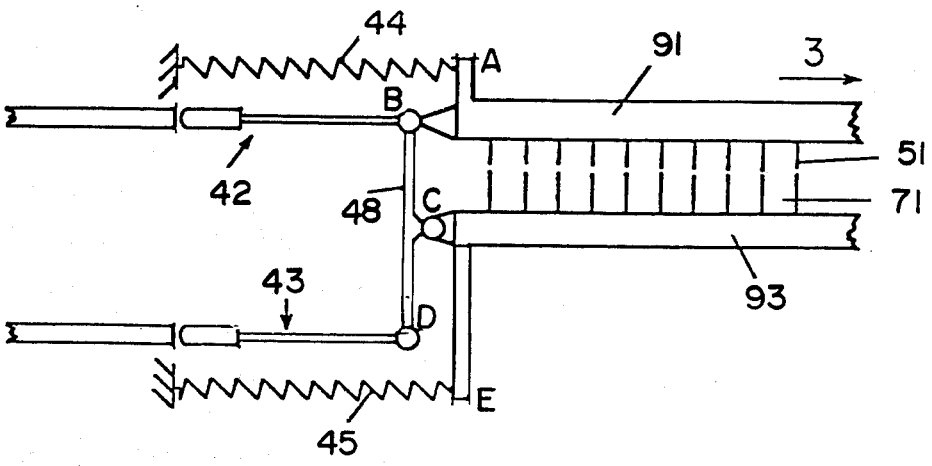
FIG. 2 shows in greater detail the compensation mechanism illustrated in FIG. 1.

FIG. 2 shows in more detail the manner in which the compensation lever 48 helps to overcome the undesirable influence of dropper bar 93 on guide bar 91. According to the prior art control rod 42 was connected directly to guide bar 91 and control rod 43 was connected directly to dropper bar 93 and there was otherwise no direct connection between guide bar 91 and dropper bar 93. The present invention, however, includes among other things a compensation lever 48 which helps to compensate for the undesirable influence of dropper bar 93 on guide bar 91. As can be seen clearly from FIG. 2, the compensation lever 48 is pivotally connected at point D to control rod 43 and is pivotally connected at the other end thereof to control rod 42 at point B. Intermediate the two ends B and D of compensation lever 48 is another pivotal connection at point C to dropper bar 93. FIG. 2 essentially shows the same elements as FIG. 1 except in greater detail.

According to the prior art, if control rod 43 were connected directly to dropper bar 93 and control rod 42 were connected directly to guide bar 91 and there were no compensating lever 48 between both bars, then if dropper bar moved in the direction of arrow 3 and a large number of droppers were activated, then there would be a tendency for guide bar 91 to move in the direction of arrow 3 also due to the excessive dropper/guide contact. Frequently, this undesirable tendency of the guide bar to move in the direction of arrow 3 was contrary to the pattern programmed on the periphery of the guide bar pattern cam 32.

By employing a lever such as that shown as element 48, it is possible to at least partially compensate for the undesirable momentum imparted by dropper bar 93 to guide bar 91. Without compensation lever 48 of the movement of the dropper bar 93 in the direction of arrow 3 will likewise cause the guide bar 91 to move in the direction of arrow 3 if a large number of dropper elements are deployed. However, by employing the compensation of lever 48, the movement of control rod 43 in the direction of arrow 3 will tend to propel dropper bar 93 in the direction of arrow 3 but will also tend to draw the guide bar 91 back in a direction opposite to arrow 3. In other words, movement of the control 43 in the direction of arrow 3 will tend to cause guide bar 91 to move in a direction opposite to arrow 3 and in that manner aid the return force of spring 44. Lever 48 tends to compensate for the force exerted by dropper bar 93 on guide bar 91 because the lever is pivoted around point C and therefore any motion at either point B or point D will cause an opposite directional effect at the other end. Point C, therefore, acts as a fulcrum around which lever 48 pivots. If point D moves in the direction of arrow 3 then point B will tend to move in a direction 180° opposite to arrow 3 and visaversa. In practice it has been found desirable to determine the return forces generated by return springs 44 and 45 which are connected to guide bar 91 and dropper bar 93 at points A and E respectfully. In this regard, it has been found advantageous to employ a return spring 44 which has a return force which is equal to or greater than the return force provided by spring 45.

Some modifications of the present inventioon may be obvious to those of ordinary skill in the art. For instance, it may be desirable to coil springs 44 and 45 around the body of control rods 42 and 43 respectively in order to save space. While the springs 44 and 45 are shown as being attached at points A and E to arms extending from guide bar 91 and dropper bar 93 respectively, it should be appreciated that the drawing is merely a schematic representation and that the apparent length of the arms is not meant to be construed literally. The arms in FIG. 2 have been extended to better illustrate their schematic relationship to other elements but in actuality the connection point of springs 44 and 45 could be placed closer to the principal axis of the guide bar 91 or dropper bar 93. Therefore, in order to avoid any significant leverage moments, it is desirable to bring the springs as closely as possible to the ambit of the guide and dropper bar axis. Additionally, other types of mechanical linkages might be used to provide the same effect as that derived from compensation lever 48. In practice, however, the use of a simple mechanical linkage such as that shown as element 48 has been found to be a most direct and efficient method of solving an otherwise difficult problem.

While the invention has been particularly shown and described with reference to the preferred embodiment thereof, it will be understood by those skilled in the art the various changes in form and detail may be made therein without departing from the spirit and scope of the invention.

What is claimed is:

1. An apparatus adapted for use on a warp knitting machine equipped with Jacquard controls, the apparatus comprising:

a guide bar;

a guide bar control means;

a dropper bar associated with said guide bar;

a dropper bar control means;

return means for biasing said guide bar and dropper bar against their respective control means; and, a compensation means for increasing the bias force upon said guide bar in one direction when the movement of said dropper bar is in the opposite direction, said compensation means comprising a lever means pivotally connected to said guide bar and to said dropper bar.

2. The apparatus of Claim 1 wherein said lever means is pivotally connected to said guide bar at a first point and pivotally connected to said dropper bar control means at a second point.

3. The apparatus of Claim 2 wherein said dropper bar is pivotally connected to said lever means at a third point intermediate said first and second points.

4. The apparatus of Claim 3 wherein said first and second points comprise the ends of said lever means.

5. The apparatus of Claim 4 wherein said guide bar control means and said dropper bar control means comprise control rods.

6. The apparatus of Claim 2 wherein said return means comprises a guide spring means having a first end thereof connected to said guide bar and a dropper spring means having a first end thereof connected to said dropper bar, each of said spring means having a second end thereof connected to an anchor means.

7. The apparatus of Claim 6 wherein the dropper spring means exerts a force upon said dropper bar that is less than the force exerted upon the guide bar by the guide bar spring means.

* * * * *